US005875978A

United States Patent [19]

Wingler et al.

[11] Patent Number: 5,875,978

[45] Date of Patent: Mar. 2, 1999

[54] GRAIN MILL

[75] Inventors: Edward C Wingler, Scottsville; Charles E Wingler, Sr., Piney Creek, both of N.C.

[73] Assignee: New River Mills LLC, Columbia, S.C.

[21] Appl. No.: 806,664

[22] Filed: Feb. 26, 1997

Related U.S. Application Data

[63] Continuation-in-part of Ser. No. 629,981, Apr. 9, 1996, Pat. No. 5,673,862.

[51] Int. Cl.[6] ..... B02C 7/14

[52] U.S. Cl. ..... 241/55; 241/259.1; 241/261.2

[58] Field of Search ..... 241/55, 57, 261.2, 241/261.3, 259.1

[56] References Cited

U.S. PATENT DOCUMENTS

| | | | |
|---|---|---|---|
| 237,120 | 2/1881 | Mills | 241/57 |
| 2,937,815 | 5/1960 | Eirich et al. | 241/57 |
| 3,055,598 | 9/1962 | Ginaven | 241/57 |
| 5,673,862 | 10/1997 | Wingler | 241/259.1 |

*Primary Examiner*—Mark Rosenbaum
*Attorney, Agent, or Firm*—Michael A Mann

[57] ABSTRACT

A grain mill is disclosed comprising a heat-dissipating, stainless steel housing that holds a pair of grinding stones, one of which rotates with a shaft turned by an electric motor. The shaft is journaled on self-aligning bearings. The bearings and the housing cooperate to keep heat buildup from the grinding operation low so as not to damage the grain, even at higher grinding speed. As an additional check on mill temperature, a thermometer is included to provide temperature information, and an ammeter is connected to the electrical motor to provide information about the electrical current being drawn when the motor rotates the shaft as an indication of the stress on the shaft. A small door near the exit spout permits a check of the uniformity and size of the ground product. Finally, magnets on the hopper attract metal particles and hold them so that they do not enter the space between the grind stones, where they could damage the stones and become part of the product. Accordingly, the present mill is capable of higher productivity and a higher quality product. Numerous other improvements in the present mill make it easier to operate and more durable.

12 Claims, 7 Drawing Sheets

GRAIN MILL

This application is a continuation-in-part application of a co-pending application, Ser. No. 08/629,981 filed on Apr. 9, 1996.

BACKGROUND OF THE INVENTION

1. Field of the Invention

The present invention relates to mills for grinding or milling grains such as wheat, rice, corn, oats, rye, barley and coffee. More particularly, the present invention is a portable flour mill for use by a small bakery.

2. Discussion of Background

There exists in the art a variety of different rotary grinding mills for grinding wheat, corn, rye, oats, barley, rice, coffee and other grains. Mills have been known for centuries. Currently, small portable mills are used by smaller bakeries to mill grains for specialty breads. Mill technology is very traditional. Typically, such machines comprise a cast iron housing with a pair of circular, pink granite grinding stones, spaced a preselected, small distance apart. One of the stones, commonly referred to as the "running stone," is turned by a shaft, while the other stone, the "bed" stone, remains stationary. Grain is fed into the mill from a hopper to a rotating auger, and then into the space defined by the separation between the opposing faces of the stones. After the grain is milled to flour, the flour is removed from the interior of the mill for collection and further processing.

One problem repeatedly encountered in the art is the durability of the moving components of the mill. In particular, the shaft can be seized by the cast iron ball bearing assemblies through which the shaft is journaled when frictional heat welds the bearings to the shaft. Also, vibration from the motor that turns the shaft along with misalignment of the running stone causes the turning shaft to deviate from its normal, horizontal position, resulting in interference, frictional heat buildup, and excessive wear. In addition, heat from friction can damage the grain, as will be explained below.

If the machine is run continuously, heat builds in the housing and heats the grain. When the grain becomes overheated, it begins to break down chemically. For example, when wheat embryo, or the wheat kernel, experiences a temperature of approximately 130° F. or greater, it loses its protein content. Furthermore, products made from overheated wheat flour are less flavorful. To limit heat buildup as well as prevent damage to moving parts, the running stone is rotated at a slower speed and for shorter periods of time to allow dissipation of the heat. However, neither of these solutions is acceptable, since both adversely affect the productivity of the grinding operation.

Another problem is the existence of metal particles that chip off the hopper and fall into the wheat. Most mills sift the wheat, as has been done for decades, to remove stones and other foreign particles. However, metal particles are not removed. These contact the stone faces and produce surface irregularities that affect the surface of the grinding stones and require them to be smoothed and flattened, or "dressed," more frequently. In addition, failure to remove these metal particles prior to milling affects flour quality.

Size inconsistencies in the milled product are yet another problem faced by the industry. Normally, the distance between the grinding stones, and hence the resulting fineness of the milled product, is adjusted by using a threaded screw, usually having eight threads per inch, which is positioned to abut the end of the turning shaft. Turning the screw moves the shaft, and thus the relative positions of the running and bed stones. Rotation of the shaft exerts a force in the direction of the screw that, over time, wears on the screw's threads. Eventually, the adjustment screw cannot be relied on to accurately maintain the correct separation of the stones, and as a result, the output from the mill contains particles of non-uniform size.

Because of the traditional approach to mill manufacture, the problems of heat buildup, frequent breakdowns, low output, and uneven quality of the output have not been addressed. There exists a need for a durable mill that produces a high quality product with high productivity.

SUMMARY OF THE INVENTION

According to its major aspects and briefly stated, the present invention is a rotary grinding mill. The mill comprises a stainless steel housing in which is mounted two grinding stones placed in spaced, opposing axial alignment. One stone, the "bed stone," is immobile or stationary, while the other, the "running stone," rotates about its axis. A shaft that is turned by a motor rotates the running stone. The shaft is journaled in self-aligning bearings that allow the shaft to deviate as much as ±30°. A screw, with preferably 24 threads per inch rather than the conventional eight threads per inch, engages one end of the shaft, and permits fine, stable adjustment of the distance between the grinding stones and the fixation of that distance.

Grain is introduced into the interior of the mill via a hopper positioned above the grinding stones and mounted to the exterior of the housing. Upon entering the hopper, the grain falls into an angled pan carrying several magnets to catch and hold metal particles in the grain. The sifter present in traditional mills has been eliminated in the present design as unnecessary, thus eliminating a source of noise and frequent mechanical problems. The grain then falls down a channel within the interior of the housing to a feed screw carried by the shaft. The feed screw forwards the grain through a cavity centrally formed in the bed stone to the space between the stones, to the area where it is subsequently milled. After being milled by the stones, the flour is swept from the interior of the housing by sweepers carried on the exterior of the running stone and is collected in a receptacle. The mill is mounted on a steel tubing frame riding on casters to facilitate movement.

A number of features of the present invention cooperate together to produce a higher-quality product. To increase production, the shaft is turned faster. However, in order to avoid the heat buildup associated with faster grinding, which would damage the grain, the housing is made of heat dissipating stainless steel, and the bearings are self-aligning so that friction is reduced from conventional cast iron housings and bearings. To give the user information related to the quality of the product, a thermometer carried by the exit spout enables a quick check on temperature. An ammeter connected to the motor that turns the shaft enables a check on the electrical current drawn by the motor as an indirect measurement of stress on the shaft from, say, overfeeding. Finally, a small door allows the user to feel the ground product for size and uniformity.

A number of features combine to make the present mill relatively trouble-free and easier to use. For example, the shaft adjustment assembly uses a fine threaded screw in a brass housing to enable the position of the shaft, and thus the running stone, to be set where the user wants it and fixes it in place so that it does not easily move from the desired location. The use of stainless steel for the housing makes it easier to clean. The removal of the traditional mechanical sifter makes the unit quieter and eliminates a source of mechanical breakdown. The use of magnets on the hopper to pick up metallic particles that would otherwise damage the stones is important because it reduces the number of times the stones need to be dressed, i.e., cleaned, smoothed, and flattened. Furthermore, when the stones need to be dressed, the longer frame of the present invention, with a polyethylene or tetrafluorohydrocarbon-coated surface, enables the stones to be slid apart easily, but left on the frame during dressing. Thus, the heavy stones do not need to be repeatedly lifted off the frame while being dressed. As a result, the otherwise unproductive time spent dressing the stones is reduced and made easier.

The use of modern self-aligning bearings which enable the running stone to rotate at a higher speed (measured in revolutions per minute or RPM) and a faster rate of rotation of the shaft, improves productivity of the present mill over previous mills. The self-aligning bearings permit the shaft to deviate from its normal horizontal position to accommodate the vibration imparted by the motor and misalignment of the running stone. Consequently, the shaft is capable of rotating at a higher RPM. As a result, the mill is capable of higher output, approximately 20% higher. Specifically, a mill according to the present invention equipped with 16 inch stones is capable of grinding approximately 350–400 pounds of flour per hour. With 30 inch stones, the mill yields approximately 1000–1200 pounds per hour.

In another of the preferred embodiments, the use of a back plate and fan blades positioned on the rear of the running stone increase the productivity of the mill. The back plate combined with an internal sleeve joins the turning shaft to the running stone which further secures them together so that the rotational motion of the turning shaft is translated to the running stone without slippage. In addition, positioned within the cut-out portion of the running stone about the internal sleeve is a USDA and FDA approved stainless steel epoxy, thus further securing the turning shaft to the running stone.

As the turning shaft and the running stone rotate, the fan blades are positioned and angled to draw air into the interior of the housing through a series of holes in the second side of the housing. The intake of fresh air facilitates the cooling of the flour and the mill, thus preventing its overheating. In addition, the flow of air helps force the milled grain out the housing.

The use of a helical groove and grease seal within the adjustment assembly is also an important feature as they combine to reduce the frictional wear experienced by the adjustment assembly parts. The helical groove aids in the migration of grease from its inlet ports throughout the moving parts, while the seal retains the grease within the assembly, thus preventing contamination of the milled grain.

Other features and their advantages will be apparent to those skilled in the art from a careful reading of the Detailed Description of Preferred Embodiments accompanied by the following drawings.

DETAILED DESCRIPTION OF PREFERRED EMBODIMENT

The present invention is a mill for milling wheat, corn, rice, barley, rye, oats, coffee, or other grains. Ideally, the present mill is sized to mill flour for a small bakery. The mill according to the present invention will operate at a temperature not exceeding approximately 100° F. and therefore will prevent thermal damage to the grains. Additionally, the mill operates at a higher RPM, approximately 20% greater than existing mills, and therefore has greater productivity. It has a number of features that make it less prone to breakdown and damage and that make it easier to use.

Figure 1:
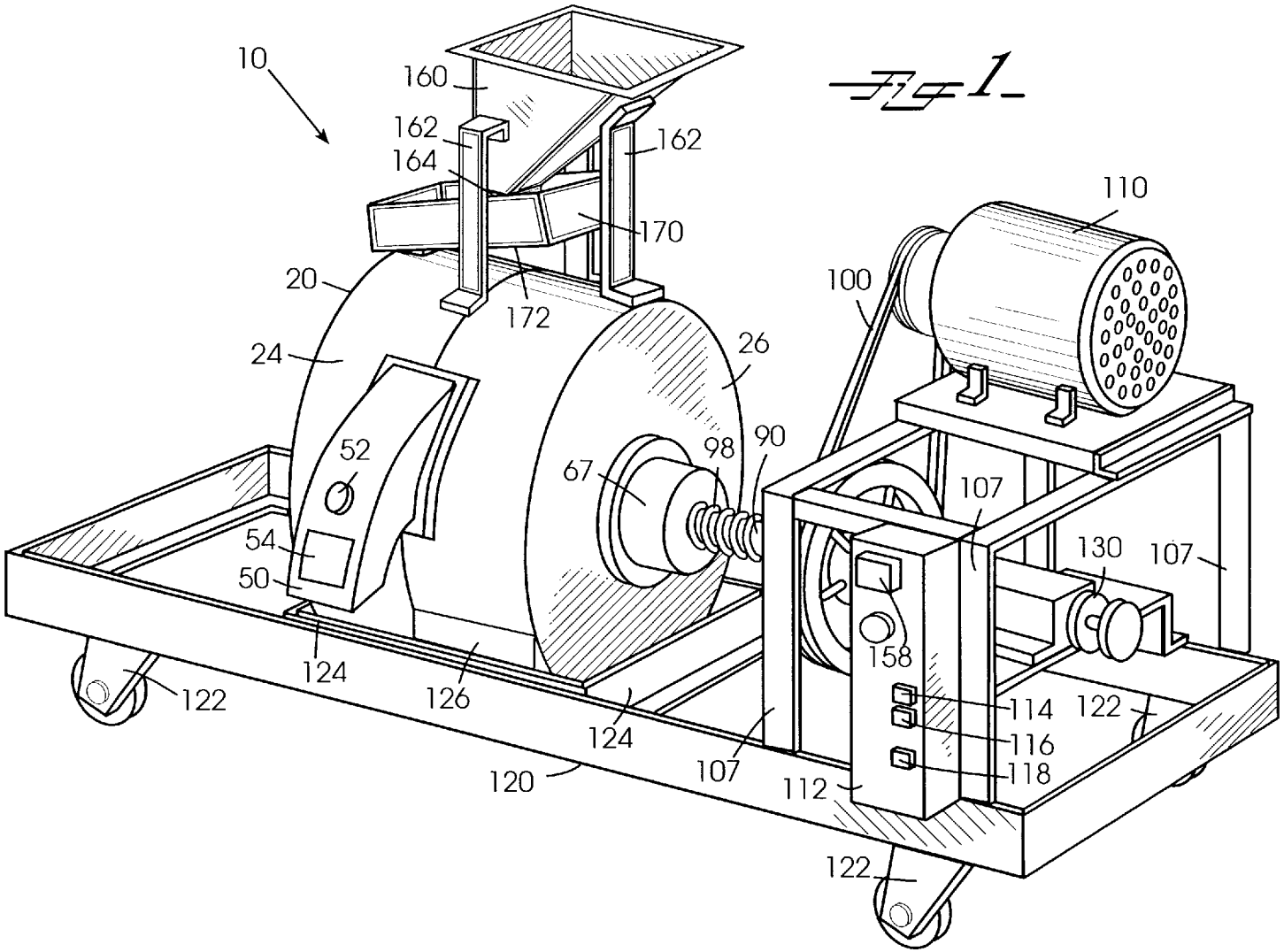
FIG. 1 is a perspective view of a grain mill according to a preferred embodiment of the present invention.
Figure 2:
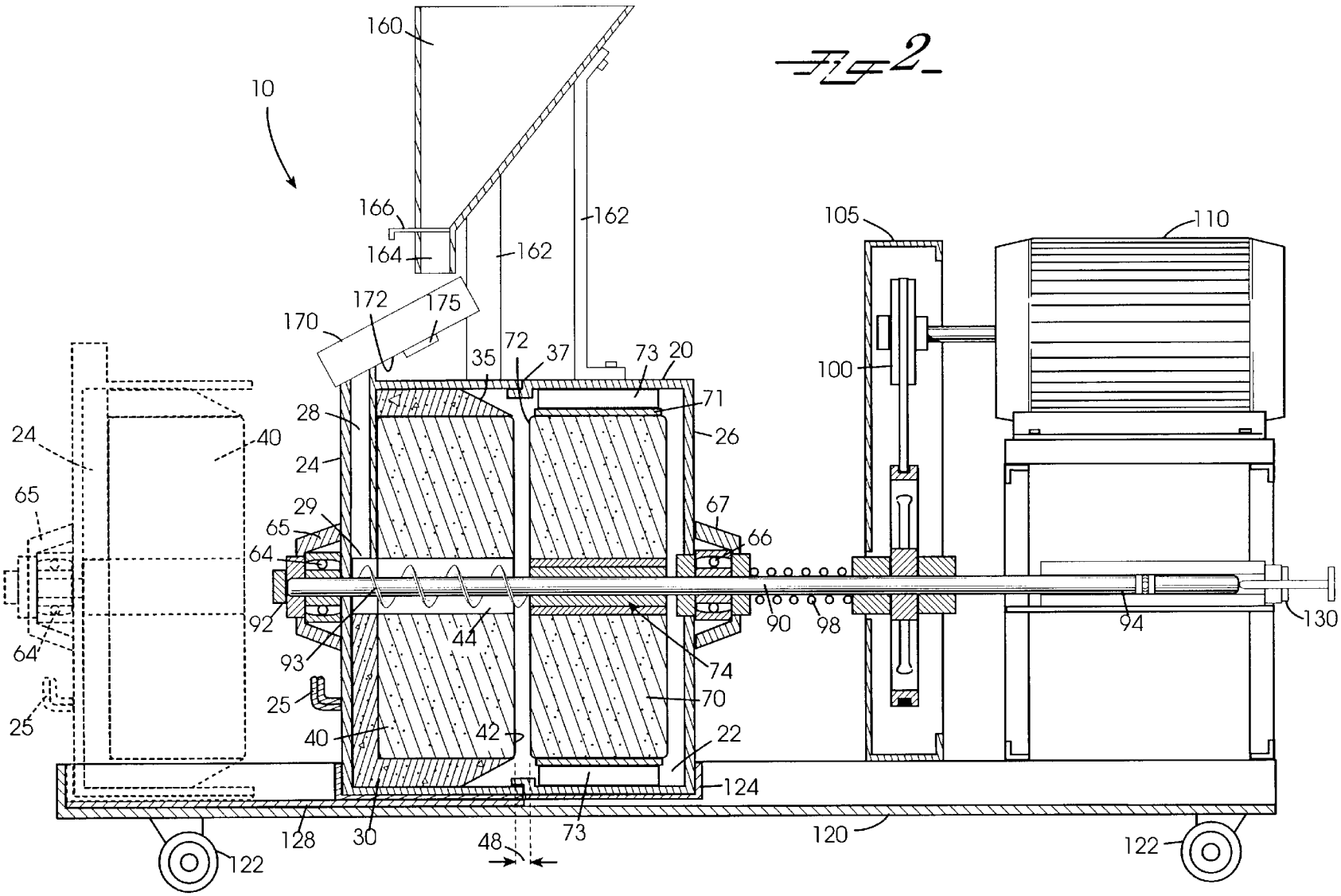
FIG. 2 is a side view of a grain mill, with a portion of the housing shown in phantom lines, according to a preferred embodiment of the present invention.

Turning now to FIGS. 1 and 2, there is shown in perspective and side cross-sectional, respectively, a mill according a preferred embodiment of the present invention and indicated generally by reference numeral 10. Mill 10 comprises a stainless steel housing 20 having an interior 22, first side 24 and a second side 26, a first stone 40, and a second stone 70 located in interior 22 of housing 20, a turning shaft 90, a motor 110 for rotatably driving turning shaft 90 via drive pulley system 100, a frame 120, an adjustment assembly 130, and a hopper 160. Motor 110 is supported a distance above turning shaft 90 by a series of members 107 extending from frame 120.

Housing 20 is made to be heat dissipating, preferably by making it of a material with a high thermal conductivity (and strength) such as stainless steel. Alternatively, heat dissipating features, such as fins, can be incorporated if necessary to speed heat dissipation. However, stainless steel having a nominal thickness of ¼ inch provides a good combination of strength and high thermal conductivity needed for present purposes and is not as brittle as cast iron.

First stone 40, commonly referred to as the stationary or bed stone, and second stone 70, the running stone, are separated by a distance 48, and each have a grinding face 42 and 72 and a cut out portion 44 and 74, respectively. Normally, stones 40 and 70 are made of pink granite which includes a small amount of marble. However, it is recognized that stones 40 and 70 can be made of any synthetic or natural material that is commonly employed in the art of milling grain. First stone 40 is rigidly affixed to interior 22 of housing 20 by cement 30. When cement 30 is laid around the perimeter of first stone 40, it is formed to have an angled surface 35. Angled surface 35 enables an annular flange 37 formed in second side 26 of housing 20 to slidingly engage first side 24. Second stone 70 has about its perimeter a metal band 71. The purpose of band 71 is to prevent dislodgment of pieces of stone 70 while the stone is rotating. Extending from band 71 are a series of blades 73. When second stone 70 rotates, blades 73 sweep grain from interior 22 of housing 20 by pushing it through an exit spout 50.

First end 92 of shaft 90 is journaled within a first set of self-aligning bearings 64 supported by first side 24 of housing 20 in a casing 65. Shaft 90 runs through cut out portion 44 of first stone 40 and is journaled to second stone 70 in a manner which will be discussed below. Upon exiting interior 22 of housing 20, shaft 90 is journaled through a second set of self-aligning bearings 66, supported by second side 26 of housing 20 in a casing 67. Shaft 90 is further connected to pulley system 100 and is maintained at a fixed distance therefrom by spring 98. Second end 94 of shaft 90 terminates within adjustment assembly 130. Positioned about pulley system 100 is a guard 105 that helps avoid injury during the operation of mill 10.

The self-aligning bearings 64, 66 can be any type of self-aligning bearing sized for the shaft. Preferably, bearings 64, 66 accommodate deviations of shaft 90 of up to 30°, but at least a few degrees in view of the weight of second stone 70, which typically weighs several hundred pounds.

Hopper 160 is positioned above housing 20 and is supported thereby by a plurality of members 162. About mouth 164 of hopper 160 is an adjustable gate 166. Gate 166 enables the amount of grain exiting hopper 160 to be regulated. Positioned below mouth 164 of hopper 160 is an angled pan 170 having a plurality of magnets 175 positioned in bottom 172. Magnets 175 remove metal particles from the grain as it falls from hopper 160. Removing these metal particles before they enter the mill protects the surfaces of grinding stones 40, 70 and prevents impurities in the milled product. In prior art mills, a sifter sifted the grain for small stones and other foreign matter. The sifter was shaken by cam action of shaft 90. However, wheat, for example, is triply washed before being placed into the hopper so sifting for foreign matter is unnecessary, and thus, the sifter has been removed. Along with its removal are the associated mechanical problems, breakdowns and noise of the sifter as it operates.

Grain runs down pan 170 and enters interior 22 of housing 20 via stainless steel channel 28. Located at the bottom 29 of channel 28 is a screw coil 93 which is arranged about shaft 90. Screw coil 93 transports grain through cut out portion 44 of first stone 40 and into the space between first stone 40 and second stone 70.

Figure 3:
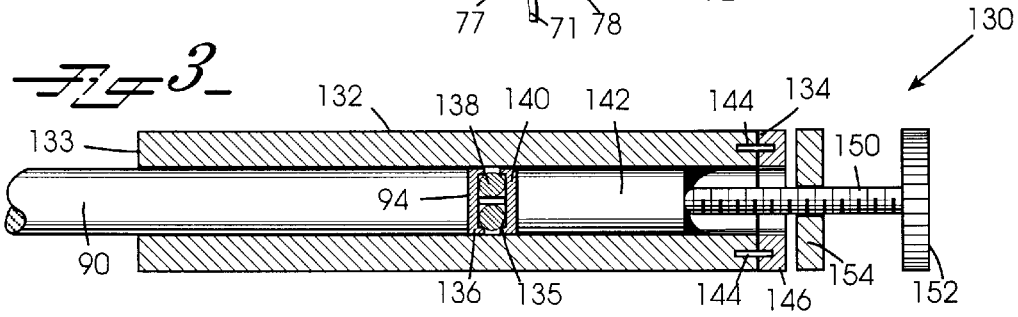
FIG. 3 is a detailed, cross-sectional side view of an adjustment assembly of a grain mill according to a preferred embodiment of the present invention.

Turning now to FIG. 3, there is shown a detailed cross-sectional side view of adjustment means 130. Adjustment means 130 permits distance 48 between stones 40 and 70 to be adjusted, thereby enabling the fineness of the milled grain to be controlled. Adjustment assembly 130 contains a collar 132 having a first end 133 and a second end 134. Second end 94 of shaft 90 is positioned within collar 132 and extends beyond first end 133. A thrust bearing assembly 135, preferably made of brass and having a first race 136, a series of bearings 138 and a second race 140, is positioned within collar 132 and between end 94 of shaft 90 and a follow block 142. Attached to second end 134 by set screws 144 is a seal 146. An adjustment screw 150 having an adjustment nut 152 and a locking nut 154 is threaded through seal 146 and embedded in follow block 142. Preferably, adjustment screw 150 is at least 24 threads per inch so that distance 48 can be accurately adjusted, and, once adjusted, will remain fixed until the user wants to make a different adjustment. This is an important improvement. The adjustment assembly 130 sets the separation distance between the stones, which is a small distance, typically less than the thickness of a sheet of paper. This distance determines the fineness of the grind. If the distance tends to increase by the backing of shaft 90, the grind will gradually become coarser. If the distance tends to vary, the stones may interfere, thus causing premature wear, overheating, variation in grind fineness, and equipment breakdown.

Adjustment of distance 48 by adjustment assembly 130 is accomplished as follows: locking nut 154 is first rotated away from seal 146. Thereafter, adjustment nut 152 is rotated, causing follow block 142 to move linearly and thereby move shaft 90 in the same direction. When proper adjustment is achieved, locking nut 154 is rotated toward seal 146. When shaft 90 is rotating, it will transfer rotational energy into first race 136 and subsequently into bearings 138, where the energy will be absorbed. By absorbing this energy in bearings 138, damage and the eventual destruction of adjustment screw 150 is eliminated. Moreover, the correct distance 48 between stones 40 and 70 is maintained, despite continuous use.

Figure 4:
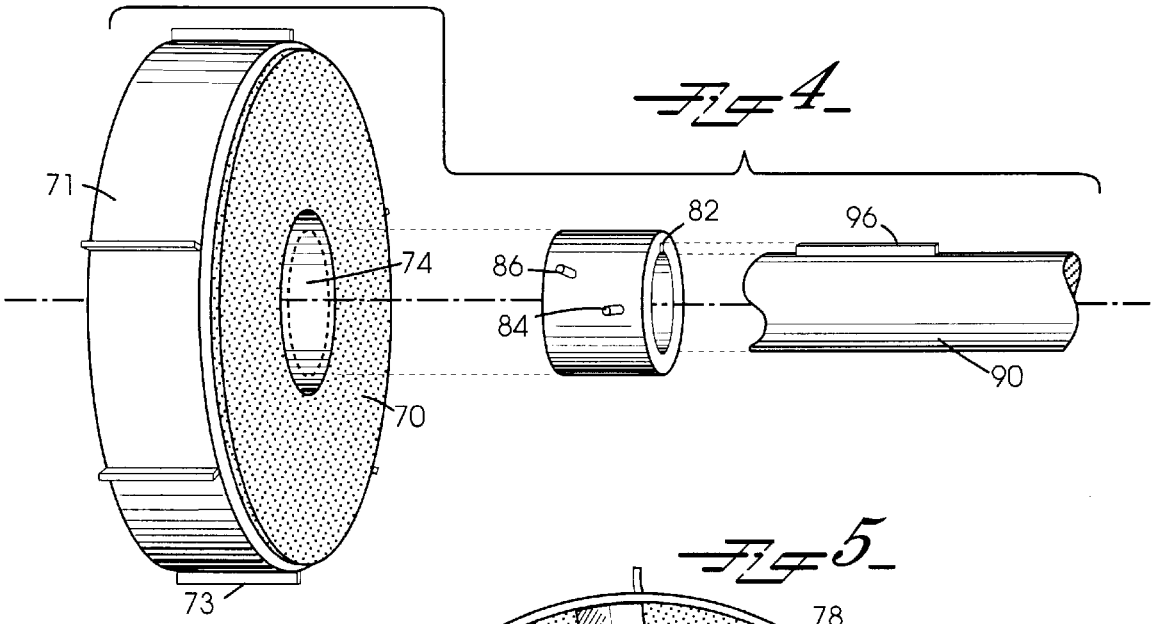
FIG. 4 is a perspective, exploded view of the running stone and shaft assembly of a grain mill according to a preferred embodiment of the present invention.
Figure 5:
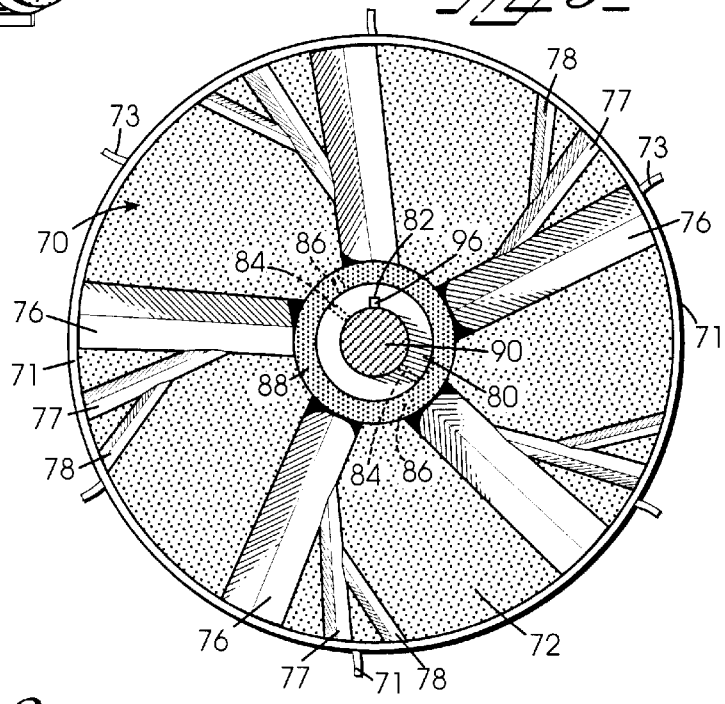
FIG. 5 is a partial cross-sectional front view of the running stone and shaft assembly of a grain mill according to a preferred embodiment of the present invention.

Turning now to FIGS. 4 and 5, there is shown an exploded perspective view and front view, respectively, depicting the attachment of shaft 90 to second stone 70. Shaft 90 is fitted with a key 96 which is inserted into a slot 82 formed in an annular hub 80. Positioned about the exterior of hub 80 are a pair of set screws 84 and a pair of bolts 86. Set screws 84 are tightened onto shaft 90. Thereafter, hub 80 and shaft 90 are inserted into cut-out portion 74 a distance, so that bolts 86 are within cut-out portion 74, while set screws 84 are exterior to cut-out portion 74. Cut-out portion 74 is then filled with babbit 88 to secure hub 80 and shaft 90 to second stone 70. Any form of babbit commonly used in the art that is capable of securing shaft 90 and hub 80 to second stone 70 can be used.

There is a control panel 112 mounted to frame 120. Control panel 112 contains an "on" button 114 which activates motor 110, an "off" button 116 which deactivates motor 110, and a reset button 118. Control panel 112 also contains an ammeter 158 which monitors the current drawn by motor 110 and indirectly measures stress on the shaft being rotated by the motor. If ammeter 158 displays a current above a preselected level, it is an indication that either distance 48 between stones 40 and 70 is too small or interior 22 of mill 10 is receiving too much grain, i.e., is being overfed. The exact amperage value which indicates the occurrence of the above described conditions will vary depending upon the size of motor 110, the desired revolutions per minute and the desired fineness of the grain, and therefore will require a modest amount of experimentation by one with ordinary skill in the art.

Positioned on exit spout 50 is a temperature gauge 52 which reads the temperature within interior 22 of housing 20. It is important that the temperature within interior 22 be below a certain value to avoid overheating the grain. The exact temperature at which overheating occurs varies depending on the type of grain being milled; however, in no instance should the temperature within interior 22 exceed 130° F. Preferably, the temperature of interior 22 is below 120° F., and most preferably below 110° F. Also positioned in exit spout 50 is an access door 54. Door 54 permits an operator to reach into and remove the milled grain flowing through exit spout 50 and to examine the grain for the required fineness and consistency.

The door 54 and temperature gauge 52, missing from traditional mills, are an important source of information to the user. Without that information, the quality of the product and the condition of the mill are unknown until it may be too late to prevent the production of a grind of poor quality or damage to the mill.

Frame 120 has depending therefrom a plurality of castors 122 which aid in the movement and transportation of mill 10. There exists support members 124 positioned about the perimeter of the exterior of housing 20. In addition, about side 26 of housing 20 there are angled supports 126. Support members 124 provide additional support for housing 20, while angled supports 126 maintain side 26 of housing 20 in alignment during the rotation of grinding stone 70.

In operation, the distance 48 between stones 40 and 70 is adjusted using adjustment assembly 130, as described above. The operator then activates mill 10 by depressing "on" button 114. At this point, motor 110 rotates shaft 90 and grinding stone 70 via pulley system 100. Thereafter, a charge of grain is placed within hopper 160. The grain will travel through hopper 160, over magnets 175 positioned within pan 170, and into channel 28 within interior 22. The grain will then be forwarded to the space between grinding stones 40 and 70.

Grain received in the space between stones 40 and 70 is caused by the rotation of stone 70 to enter main furrows 76 formed in face 72 of stone 70, as illustrated in FIG. 5. Furrows 76 are V-shaped and have a depth of approximately ½ inch and a width of approximately 1 and ½ inches. Furrows 76 are connected to secondary furrows 77 and 78. Secondary furrows 77 and 78 are also V-shaped and are of lesser depth and width than main furrows 76. The centrifugal force exerted on the grain will cause it to migrate from the center of face 72 to its perimeter through furrows 76, 77 and 78. As the grain moves outward, centrifugal force will also force grain from furrows 76, 77 and 78. Such grain will contact faces 42 and 72 of stones 40 and 70 and will be milled to the desired fineness.

Grain that has been ground to the required fineness will be thrust from between faces 42 and 72 and will be swept by blades 73 from interior 22 through exit spout 50. Upon exiting spout 50, the grain may be received by the proper receptacle or container (not shown). Optionally, exit spout 50 may be attached to a T-connector and its dedicated motor and pump system. A T-connector (not shown) is a device well known to artisans with ordinary skill in the art of milling, that further separates grain based upon particle size or type of grain by forcing air through the milled grain.

During operation of mill 10, first and second sets of self aligning bearings 64, 66 will automatically compensate for the deviation of shaft 90 from its horizontal axis due to the vibration of motor 110 and the misalignment of second stone 70. Consequently, shaft 90 will not experience excessive friction with self aligning bearings 64 and 66. Moreover, the issue of shaft seizure is greatly reduced. As a result, shaft 90 is capable of operating at higher rotational speeds, approximately 20% greater than existing mills, with correspondingly greater output. For example, with 16" stones, mill 10 yields an output of between approximately 350 and 400 pounds per hour. A mill 10 having 30" stones will yield approximately between 1000 and 1100 pounds per hour.

The heat generated within interior 22 is effectively dissipated to the exterior by stainless steel housing 20. This heat dissipation which is characteristic of housing 20 is responsible for maintaining an average operating temperature of between approximately 85° F. and 100° F. Therefore, thermal damage to grain as a result of heat is eliminated.

When it is required to dress stones 40 and 70 or interior 22 of mill 10, an operator first removes hopper 160 from housing 20. Dressing the stones is a process of cleaning, smoothing and flattening the stones. Thereafter, using handles 25 formed on side 24 of housing 20, an operator pulls side 24, along frame 120, away from side 26. Frame 120 is made long enough to enable an operator to fully separate side 24 from side 26, permitting full servicing of stones 40 and 70. Frames of prior art mills are not long enough and require the stones to be lifted from the frame. Because dressing the stones requires them to be placed together and rotated several times, this simple change in frame length greatly reduces the exertion in dressing the stones. In addition, strips of polyurethane 128 are positioned between side 24 and frame 120, allowing an operator to separate sides 24 and 26 without excessive exertion. When dressing is completed, side 24 is pushed toward side 26 until side 24 is flush with flange 37 of side 26.

Figure 6:
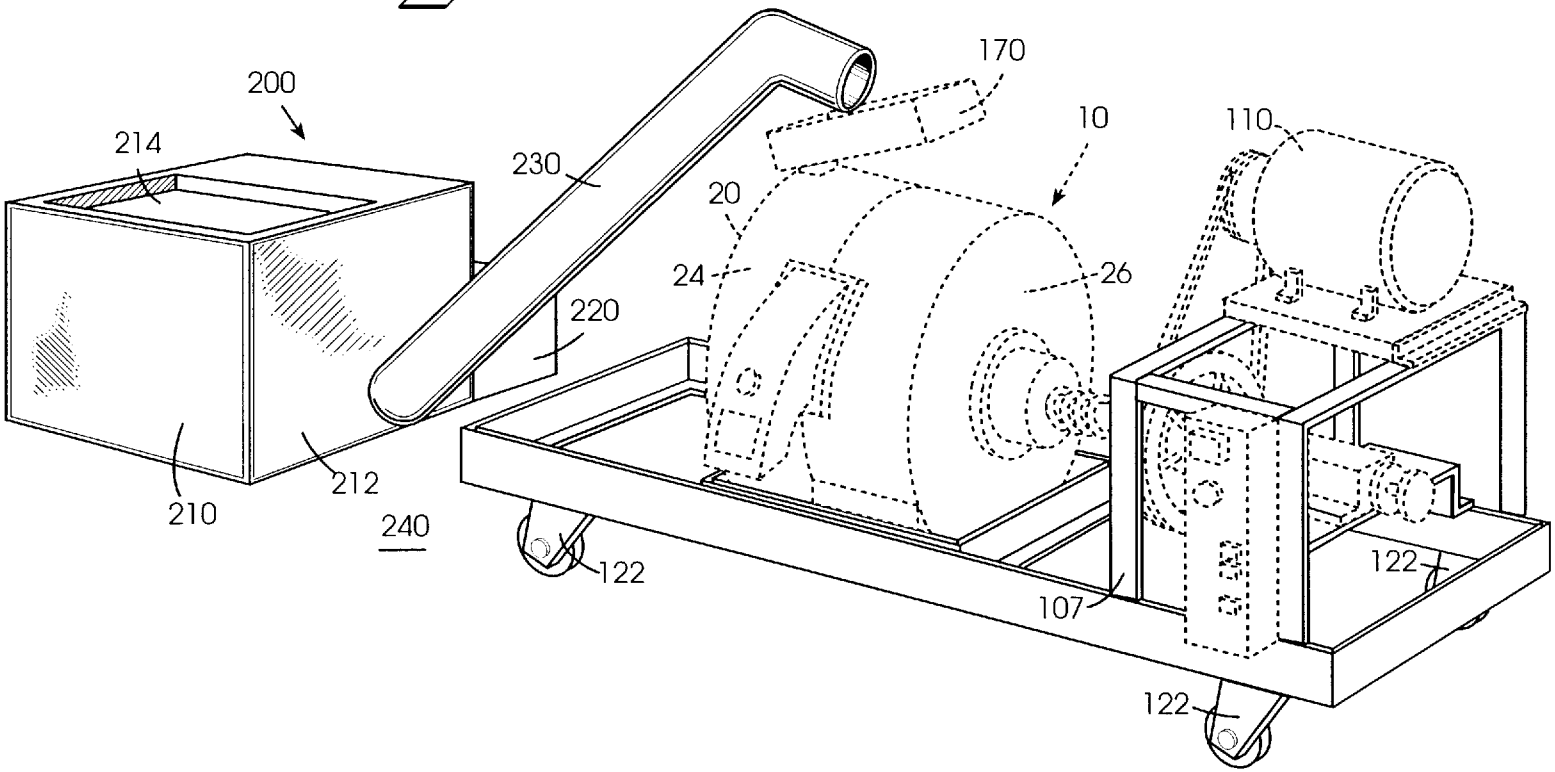
FIG. 6 is a perspective view of a grain feeder connected to a grain mill according to an alternative preferred embodiment of the present invention.

Turning now to FIG. 6, there is illustrated a mill 10 with a grain feeder 200 according to an alternative preferred embodiment of the present invention. Grain feeder 200 contains a grain storage bin 210 and a motor 220 which drives a feed auger 230 attached to side 212 of bin 210. In operation, an operator places grain in an opening 214 of bin 210 and activates motor 220. Auger 230 will then forward grain to pan 170, at which time the milling of the grain will proceed in accordance with the procedure discussed above. Bin 210 is preferably placed upon ground 240, thereby permitting an operator to place grain in opening 214 without undue exertion.

Another preferred embodiment of grain mill 10 is shown in FIGS. 7–11. Specifically, in FIG. 7, second side 26 of housing 20 of mill 10 has a plurality of holes 250 disposed about the upper hemisphere of housing 20. Holes 250 penetrate into interior 22 of housing 20, thus permitting air to flow from the exterior of housing 20 into its interior 22.

Figure 9:
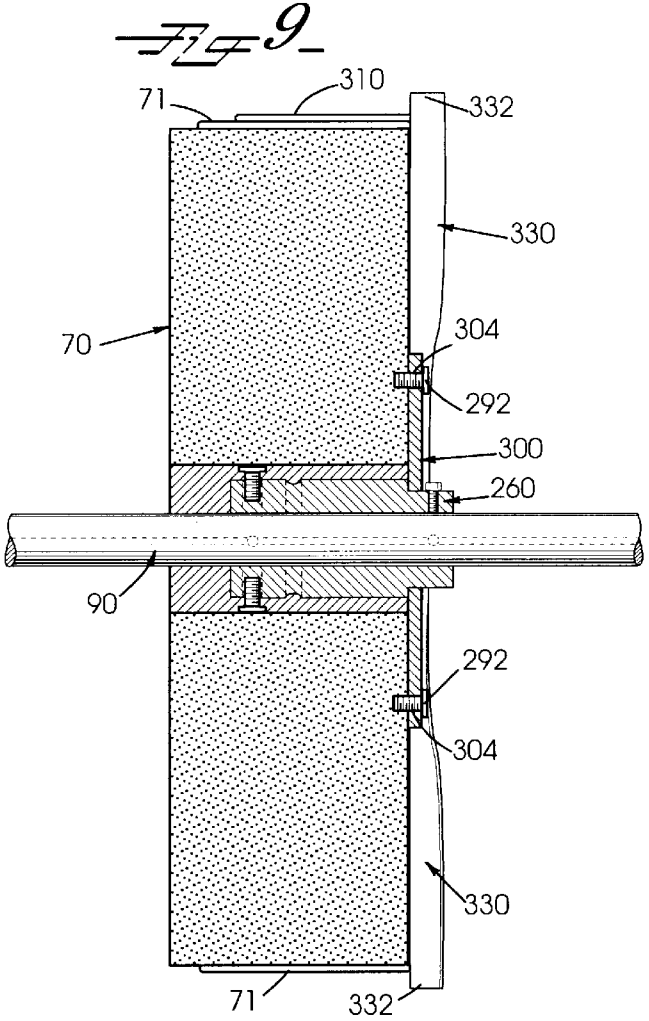
FIG. 9 is a cross-sectional view taken along line 9—9 of FIG. 8 of a running stone according to another preferred embodiment of the present invention.
Figure 8:
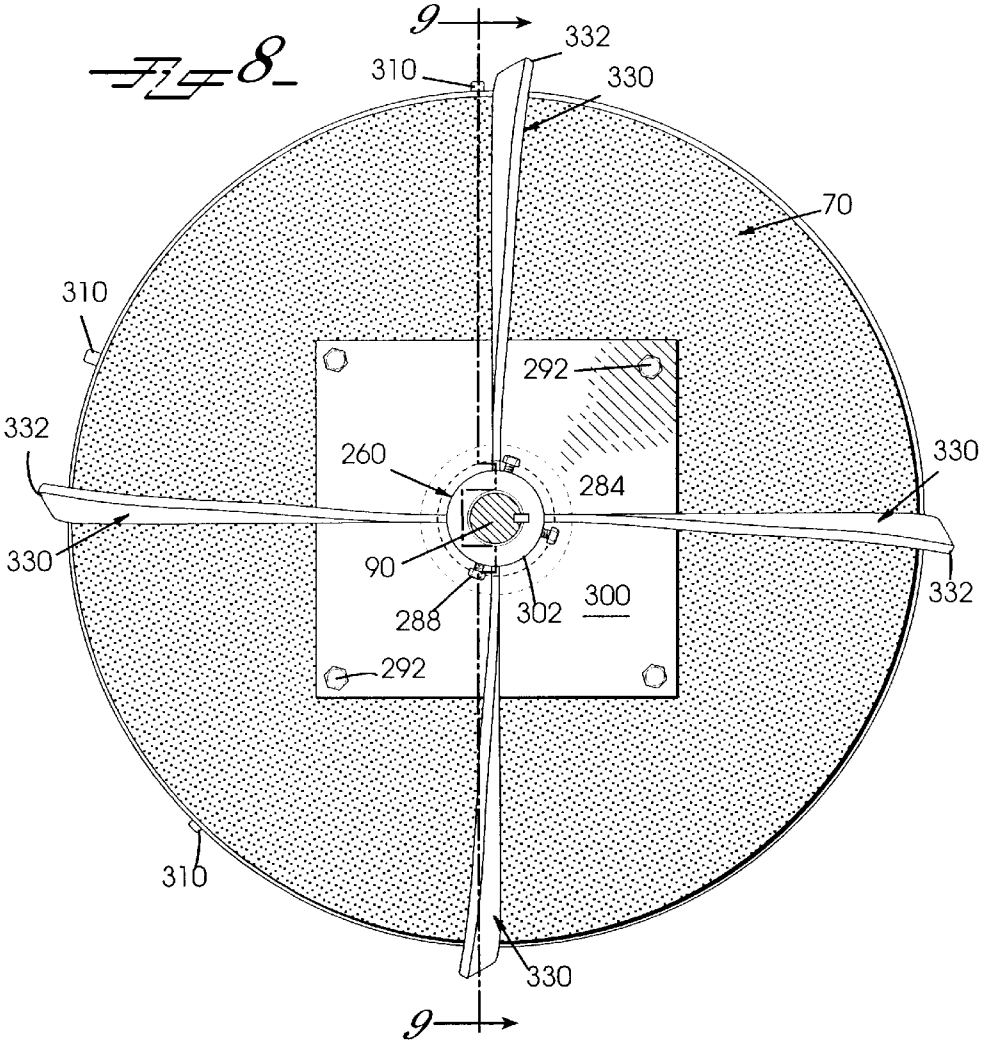
FIG. 8 is a rear view of a running stone according to another preferred of the present invention.
Figure 10:
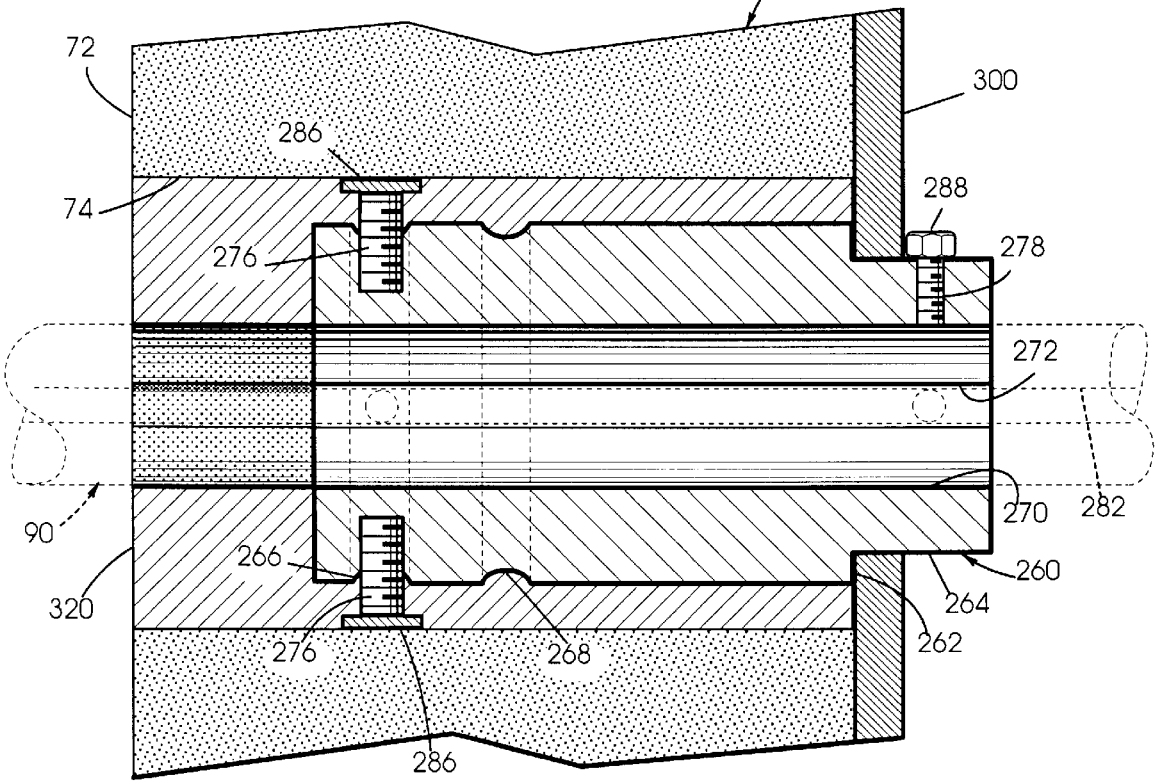
FIG. 10 is a detail view of the attachment of the turning shaft to the running stone according to another preferred embodiment of the present invention.

FIGS. 8, 9, and 10 illustrate an alternative method for mounting turning shaft 90 to second stone 70. This alternative method includes a sleeve 260 which fits about turning shaft 90 and within cut-out portion 74 of second stone 70, a back plate 300, and an epoxy 320.

In its preferred embodiment, sleeve 260 comprises an annular piece of 1018 cold rolled steel which has a shoulder 262 defining a reduced diameter portion 264 and first and second radial grooves 266, 268 cut into sleeve's 260 exterior. Sleeve 260 also has an approximately 1 11/16" channel 270 extending through its center which serves as a pathway for turning shaft 90. In addition, there is a ⅜" key-way 272 formed along the full length of this channel 270. Turning shaft 90 also has a complementary key-way 282, so that a key 284 may be positioned between turning shaft 90 and sleeve 260, thus translating the complete rotational motion of turning shaft 90 to sleeve 260.

First radial groove 266 is closer to second stone's 70 grinding face 72 than second radial groove 268. Nevertheless, each groove 266, 268 is approximately ½" wide and ½" deep, while first radial groove 266 has a first set of tapped holes 276 (preferably three) disposed radially within the groove. First set of tapped holes 276, however, do not extend through sleeve 260 into channel 270, and their function will be described in more detail below.

In its preferred embodiment, the total length of sleeve 260 is approximately 5½" with an outside diameter of approximately 2 15/16". Shoulder 262 is a reduced diameter portion 264, which extends from its end distal to radial grooves 266, 268 toward radial grooves 266, 268 approximately 2". Positioned within this reduced diameter portion 264 are preferably a second set of tapped holes 278 (preferably three) disposed radially about reduced diameter portion 264, where second set of tapped holes 278 extend through sleeve 260 into channel 270.

Back plate 300 is preferably constructed from ¼" thick stainless steel having a 10" by 10" perimeter. Positioned within its center is an approximately 2⅝" center hole 302 extending completely through back plate 300. In addition there are four holes 304 positioned proximate to each corner of back plate 300.

To fasten turning shaft 90 to second stone 70, back plate 300 is positioned onto sleeve 260, with center hole 302 positioned about reduced diameter portion 264. The perimeter of center hole 302 is subsequently welded to reduced diameter portion 264 of sleeve 260. Sleeve 260 is positioned within cut-out portion 74 of second stone 70, where a first set of screws 286 are positioned within first set of tapped holes 276 in sleeve 260. These screws 286 are adjusted to axially center sleeve 260 within cut-out portion 74. In addition, anchor bolts 292 are inserted through holes 304 in back plate 300 and into the back of second stone 70 to further secure the welded combination of sleeve 260 and back plate 300 to second stone 70. Once sleeve 260 and back plate 300 are in position, turning shaft 90 is inserted through channel 270 with key 284 installed, after which epoxy 320 is poured around turning shaft 90 and sleeve 260. Once epoxy 320 has set, epoxy 320 grabs or holds onto first and second radial grooves 266, 268, thus proving a more positive grip between epoxy 320 and sleeve 260. In addition, a second set of screws 288 are inserted into second set of tapped holes 278 within reduced diameter portion 264 of sleeve 260 to further secure sleeve 260 to turning shaft 90. Those of ordinary skill in the art will recognize that the above steps for mounting turning shaft 90 to second stone 70 may be modified or alternated without departing from the spirit and scope of the present invention.

In the preferred embodiment, epoxy 320 is a stainless steel epoxy that is approved by the Food and Drug Administration (FDA) and the United States Agricultural Department (USDA). It is important that epoxy 320 not be harmful to human consumption, if a portion is milled within the flour as second stone 70 wears.

Also fastened to back plate 300 and sleeve 260 are preferably four fan blades 330 disposed axially about the back side of second stone 70. Fan blades 330 extend radially from sleeve 260 preferably beyond the perimeter of second stone 70. Fan blades 330 are slightly curved at their ends 332 in their rotational direction. In addition, each fan blade 330 is angled to draw air into housing 20 through holes 250 in the exterior of housing 20. It will be recognized that the direction of the angle of fan blades 330 to draw air into housing 20 will be dependent on the rotational direction of second stone 70. In FIGS. 8 and 9, fan blades 330 have been shown under the assumption that second stone 70 rotates clockwise while looking at the back plate 300.

The intake of air into housing 20 is especially important to the quality of flour that is produced by mill 10. Specifically, the inflow of ambient air cools the various parts of mill 10 and instantly cools the grain after it has been milled. In addition, the air flow created by fan blades 330 helps force the milled grain from mill 10 out exit spout 50.

As with the other embodiments described above, second stone 70 has metal band 71 about its perimeter to prevent pieces of stone from coming lose. However, as shown in FIGS. 8 and 9, metal band 71 also serves as a convenient location for placing and securing balancing bars 310. Balancing bars 310 help balance second stone 70 so that its center of gravity is axially aligned with turning shaft 90. This balancing is very similar to the balancing that must be done to an automobile tire, so that second stone 70 turns true, thus reducing the stress and strain experienced by turning shaft 90.

Figure 11:
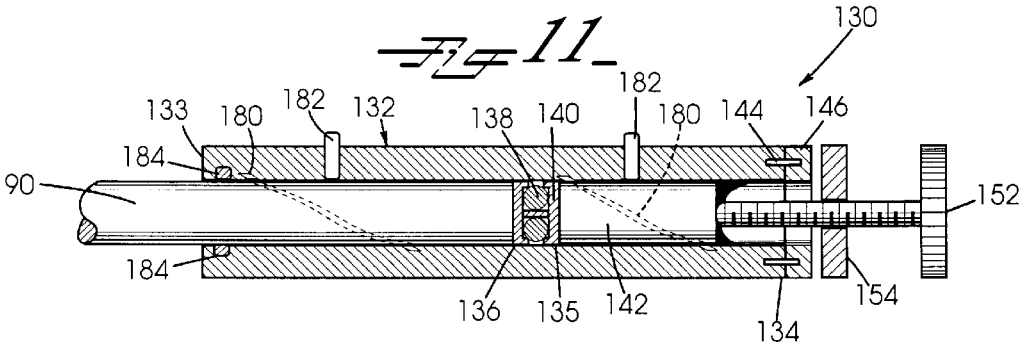
FIG. 11 is a cross-sectional view of an adjustment assembly according to another preferred embodiment of the present invention.

In FIG. 11, an alternative design for an adjustment assembly 130 is shown. This embodiment is very similar to the previously described embodiment; however the present embodiment contains a helical groove 180, two grease inlets 182, and an internal grease seal 184. The grease inlets 182 allow a supply of grease to be introduced into the interior of adjustment assembly 130, thus reducing the friction experienced by turning shaft 90 and thrust bearing 135. The helical groove 180, which in the preferred embodiment makes two complete turns down the length of collar 132, facilitates the migration of grease from the inlets 182 throughout the moving parts. Furthermore, the internal grease seal 184 at the first end 133 of collar 132 prevents the grease from exiting the confines of collar 132, while seal 146 at second end 134 of collar 132 prevents grease from escaping collar 132 at its other end. It is important that the grease be retained within collar 132, as it would be unhealthy if the grease were to contact the flour or grain.

Figure 7:
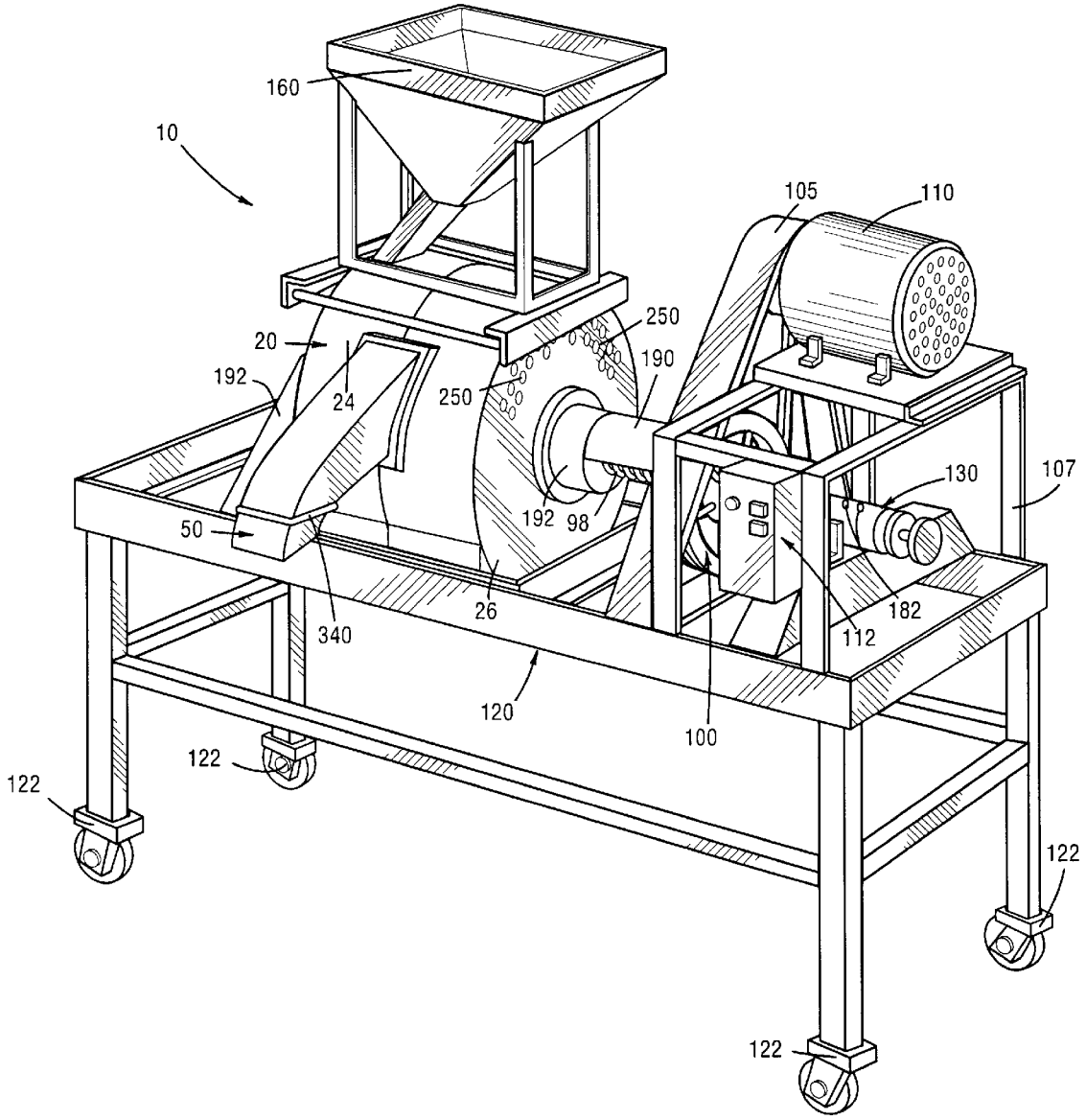
FIG. 7 is a perspective view of a grain mill according to another preferred embodiment of the present invention.

Furthermore, in FIG. 7, an alternative embodiment of exit spout 50 is shown. Exit spout 50 has a lip 340 which extends around the exterior perimeter of exit spout 50. This lip 340 provides a convenient attachment location for a bag (not shown) to capture the milled grain. Specifically, a bag is placed over exit spout 50 and lip 340, where a retaining strap (not shown) may be placed, thus preventing the bag from slipping past lip 340.

Also shown in FIG. 7, mill 10 has several guards which are used to cover mill's 10 moving parts, in order to prevent an operator from being injured. In particular, a spring guard 190 is provided that covers spring 93; a pulley guard 105 is provided that encloses pulley system 100; and a pair of bearing guards 192 are provided that cover the turning shaft 90 as it enters and exits housing 20 of mill 10.

It will be apparent to those skilled in the art that many modifications and substitutions can be made to the preferred embodiment just described without departing from the spirit and scope of the invention as defined in the appended claims.

What is claimed is:

1. A mill for milling grain, said mill comprising:

a frame;

a housing mounted to said frame and having a first side, a second side, an interior;

a first grinding stone in said interior of said housing;

a second grinding stone in said interior of said housing, said second grinding stone spaced apart from said first grinding stone, said second grinding stone having a cut-out portion;

a shaft extending through said interior of said housing;

means for mounting said second grinding stone to said shaft, said mounting means comprising:

a sleeve having a channel to receive said shaft, said sleeve also having a radial groove, a back plate positioned about said sleeve, said back plate secured to said sleeve and to said second grinding stone, and an epoxy positioned within said cut-out portion of said second grinding stone, said epoxy surrounding said sleeve within said cut-out portion; and means for rotating said shaft.

2. The mill as recited in claim 1, wherein said shaft extends through said channel within said sleeve, said shaft rotationally secured to said sleeve by a key and key-ways within both said shaft and said sleeve.

3. The mill as recited in claim 2, wherein said sleeve is further secured to said shaft by a set of screws extending through said sleeve into said channel.

4. The mill as recited in claim 1, wherein said sleeve has a reduced diameter portion about which said back plate is secured.

5. The mill as recited in claim 1, wherein said rotating means includes a motor that draws an electrical current when rotating said shaft, and wherein said mill further comprises means for monitoring said current.

6. The mill as recited in claim 1, wherein said sleeve has a pair of radial grooves.

7. The mill as recited in claim 1, wherein said mounting means further comprises a set of screws radially disposed about said radial groove, whereby said set of screws can be used for centering said sleeve within said cut-out portion.

8. The mill as recited in claim 1, wherein said epoxy is an FDA and USDA approved stainless steel epoxy.

9. A mill for milling grain, said mill comprising:

a frame;

a housing mounted to said frame and having a first side, a second side, an interior, an inlet, and an exit spout;

a first grinding stone in said interior of said housing;

a second grinding stone in said interior of said housing, said second grinding stone spaced apart from said first grinding stone by a distance;

means for moving the grain from said inlet to between said first and second grinding stones;

a shaft having a first end and a second end, said shaft extending through said interior of said housing, said second stone being attached to said shaft so that said second stone rotates when said shaft rotates;

means for adjusting said distance between said first grinding stone and said second grinding stone, said adjusting means comprising:

a collar housing said second end of shaft, said collar having at least one grease inlet and an internal helical groove extending the length of said collar, and a screw to slidably adjust said shaft within said collar; and means for mounting said second grinding stone to said shaft, said mounting means comprising:

a sleeve having a channel to receive said shaft, said sleeve also having a first and second radial groove, said channel having a key-way, said first radial groove having at least three tapped holes radially disposed within said first radial groove;

a back plate positioned about said sleeve, said back plate secured to said sleeve and to said second grinding stone by anchor bolts;

an epoxy positioned within said cut-out portion of said second grinding stone, said epoxy surrounding said sleeve within said cut-out portion; and a set of screws positioned within said at least three tapped holes, whereby said set of screws can be used to center said sleeve within said cut-out portion of said second grinding stone.

10. The mill as recited in claim 9, wherein said adjustment means further comprises a pillow block and a thrust bearing positioned between said screw and said second end of said shaft; and wherein said helical groove makes two complete turns down the length of said collar.

11. The mill as recited in claim 9, wherein said collar has an internal grease seal to prevent grease from escaping said collar.

12. The mill as recited in claim 9, wherein said second side of said housing has a plurality of holes extending into said interior of said housing; and said mill further comprising four fan blades positioned on said back side of said second grinding stone and extending radially from a position proximate to said shaft, said four fan blades extending beyond the perimeter of said second grinding stone, said four fan blades curved to draw air within said interior of said housing through said plurality of holes in said second side of said housing when said second grinding stone rotates with said shaft.

* * * * *